United States Patent [19]

Kurtzman

[11] 4,101,688

[45] Jul. 18, 1978

[54] METHOD FOR PRINTING BRAILLE CHARACTERS BY LITHOGRAPHY

[76] Inventor: Martin E. Kurtzman, 154 Harrison Ave., Island Park, N.Y. 11558

[21] Appl. No.: 707,508

[22] Filed: Jul. 22, 1976

[51] Int. Cl.[2] ..... B41K 3/68; B44F 1/10

[52] U.S. Cl. ..... 427/56; 427/145; 427/198; 427/264; 427/289; 427/375

[58] Field of Search ..... 264/129; 35/35; 427/56; 354/5; 427/145, 198, 264, 289, 375

*Primary Examiner*—Bernard D. Pianalto

*Attorney, Agent, or Firm*—Kenyon & Kenyon, Reilly, Carr & Chapin

[57] ABSTRACT

A method for printing braille characters by means of a lithographic printing process in which photosensitive sheet material is exposed to form a dot image of one or more braille characters on the sheet material. The sheet material is then developed and subsequently photographed and a negative made of the developed sheet material. The negative is stripped onto a goldenrod sheet and the stripped negative is exposed on a light-sensitive lithographic plate which is subsequently developed. The dot image developed on the lithographic plate is then offset printed on sheet material stock and the printed sheet stock is passed through a thermography machine to form raised braille characters on the sheet stock.

5 Claims, 7 Drawing Figures

METHOD FOR PRINTING BRAILLE CHARACTERS BY LITHOGRAPHY

BACKGROUND OF THE INVENTION

1. Field of the Invention

The present invention relates generally to a method for printing braille characters, and in particular to an improved method for printing braille characters by means of a lithographic printing process.

2. Description of the Prior Art

Braille is read by blind persons by running their fingers along the raised dots of a series of braille characters. Such persons can also write braille by means of a six-key writing machine known as a "Braillewriter" or by means of a stylus disposed on a pocket-size metal or plastic slate.

Methods for printing braille characters on various recording mediums are known in the art. See, for example, U.S. Pat. Nos. 3,132,962 and 1,936,089. Braille books are generally printed by utilizing metal press plates. The braille characters for the book are stamped on both sides of the paper utilized to fabricate the book by a method known as "interpointing". The characters are arranged so that dots impressed upon one side of a book page do not interfere with those printed on the other side of the page.

Computers have been used to increase the speed of production of braille books in recent years. In such systems, the computer converts ordinary punched cards prepared by a typist on a keypunch machine into cards punched with a braille code. A machine is then utilized to automatically produce metal plates from the braille-coded cards for printing of the braille book.

Manually-fed platen presses ae generally utilized to run the book plates. The presses are manually fed since paper for textbooks and literary books must be fed in a damp condition. The presses operate at about 3–5 second intervals, and press speed is approximately 1200–1720 sheets per hour. It is, thus, apparent that the cost and time involved in producing braille books for the blind is very great. As a result, most blind persons cannot, because of the cost of braille books, avail themselves of all the books they would like to read.

SUMMARY OF THE INVENTION

It is therefore an object of the present invention to overcome the aforementioned disadvantages of heretofore known printing methods and to provide an improved method for printing braille characters by means of a lithographic printing process which significantly reduces the cost and time involved in printing braille books and the like.

These and other objects of the invention are achieved in a method for printing braille characters by means of a lithographic printing process comprising the steps of exposing photosensitive sheet material to form a dot image of one or more braille characters on the sheet material; developing the exposed photosensitive sheet material; photographing the developed photosensitive sheet material and making a negative of the developed sheet material; stripping the negative onto a goldenrod sheet; exposing the stripped negative on a light-sensitive lithographic plate and developing the exposed plate; offset printing the dot image developed in the exposed lithographic plate on sheet material stock; and passing the printed sheet material stock through a thermography machine to form raised braille characters on the sheet material stock.

In the preferred embodiment of the invention, the step of exposing the photosensitive sheet material comprises exposing the material by passing light through a perforated phototypsetting disc having one or more braille characters formed therein to form a dot image of the raille characters on the sheet material stock. In another embodiment of the invention, the step of passing comprises depositing thermographic material on the image printed on the sheet material stock, and heating the sheet material stock to form the raised braille characters on the sheet material stock.

The step of exposing the photosensitive sheet material may also comprise exposing the sheet material by passing light through a perforated phototypesetting disc having one or more braille characters and a corresponding letter of the alphabet represented by the braille characters disposed below each of the braille characters formed therein to form an image of the characters and letters on the sheet material. The step of stripping the negative then comprises stripping the image of the braille characters, but not the alphabet letters, on the negative onto a goldenrod sheet.

In a further embodiment of the invention, the steps of passing, depositing and heating may comprise conveying the sheet material through a thermography machine while the image printed on the sheet material stock is wet, depositing thermographic material on the image printed on the sheet material stock, and heating the sheet material stock to melt, fuse and set the thermographic material and form the raised braille characters on the stock. The sheet material stock is then cooled subsequent to the step of heating the stock.

The objects of the invention are also achieved in printed sheet material stock produced in accordance with the described method, and in a printed sheet material stock having one or more raised braille characters printed thereon by means of a lithographic printing process.

The present invention significantly reduces the costs associated with printing braille books and the like. For example, the present invention utilizes inexpensive lithographic plates, rather than costly zinc plates, and an inexpensive offset duplicating machine. Also, the braille characters produced by the inventive method may be printed on paper or card stock which is much less expensive than the heavy, thick cardboard now used to print braille books. The present invention also eliminates the weight and size disadvantages of braille books printed on such heavy cardboard. Finally, a typical, inexpensive offset duplicating machine can operate at speeds of about 9,000 sheets per hour, which is almost 10 times faster than the speed of manually-fed platen presses now utilized. Finally, because the cost of printing braille magazines, books and periodicals is greatly reduced, the present invention will increase the number of books which are available to blind persons, thus greatly expanding their learning capability.

These and other novel features and advantages of the present invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
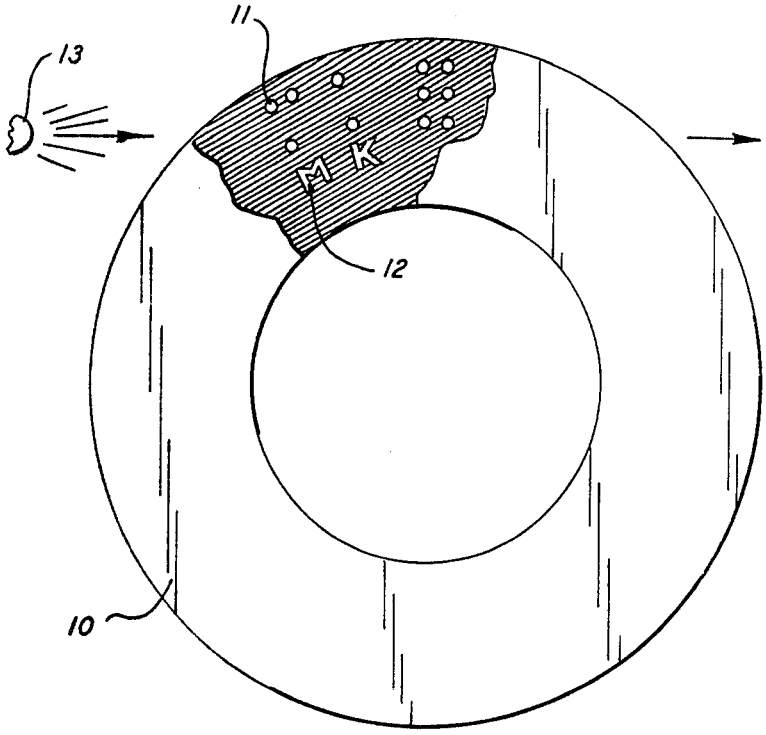
FIG. 1 is a perspective view of a phototypesetting disc and sheet of photosensitive material for use in conjunction with a braille printing method according to the present invention.

Referring now to the drawings, there is shown, in FIG. 1, a phototypesetting disc 10, which may comprise, for example, a Photon Pacesetter disc, which is perforated and has a plurality of braille characters 11 formed therein. The disc preferably contains the sixty three possible dot arrangements of the braille alphabet, and, in addition, a corresponding letter of the alphabet 12 disposed below each of the braille characters formed in the disc. Light emanating from a suitable light source 13 passes through the perforated disc and exposes a sheet of photosensitive material 14 to form a positive dot image 15 of characters 11 and letters 12 on sheet 14. Access to the braille characters and alphabet letters formed on phototypesetting disc 10 can be effected by means of a six-level TTS keyboard, such as, for example, an AKI CIT 70 keyboard. If desired, a computer in which each of the sixty three braille dot formations is defined can be utilized to accept phototypesetting tapes. Such an arrangement obviates the need for skill during the keyboarding process, since all the keyboard operator has to do is set the copy word for word without concern for contractions. The computer then reads the input tape and develops a new tape for the phototypesetting machine. These tapes can be proofread by using a correct-edit terminal. Once the tapes are determined to be correct, they are placed in the phototypesetting machine for exposure of the photosensitive sheet material.

Figure 2:
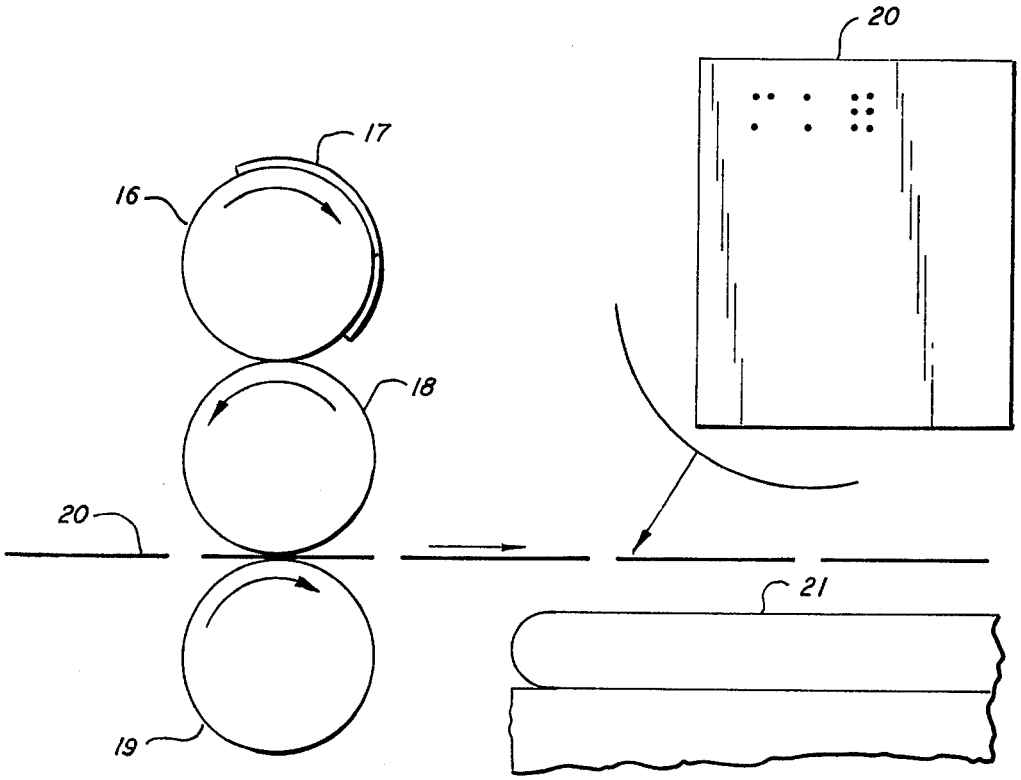
FIG. 2 is a schematic illustration of an offset duplicating machine for use in conjunction with a braille printing method according to the present invention.
Figure 3:
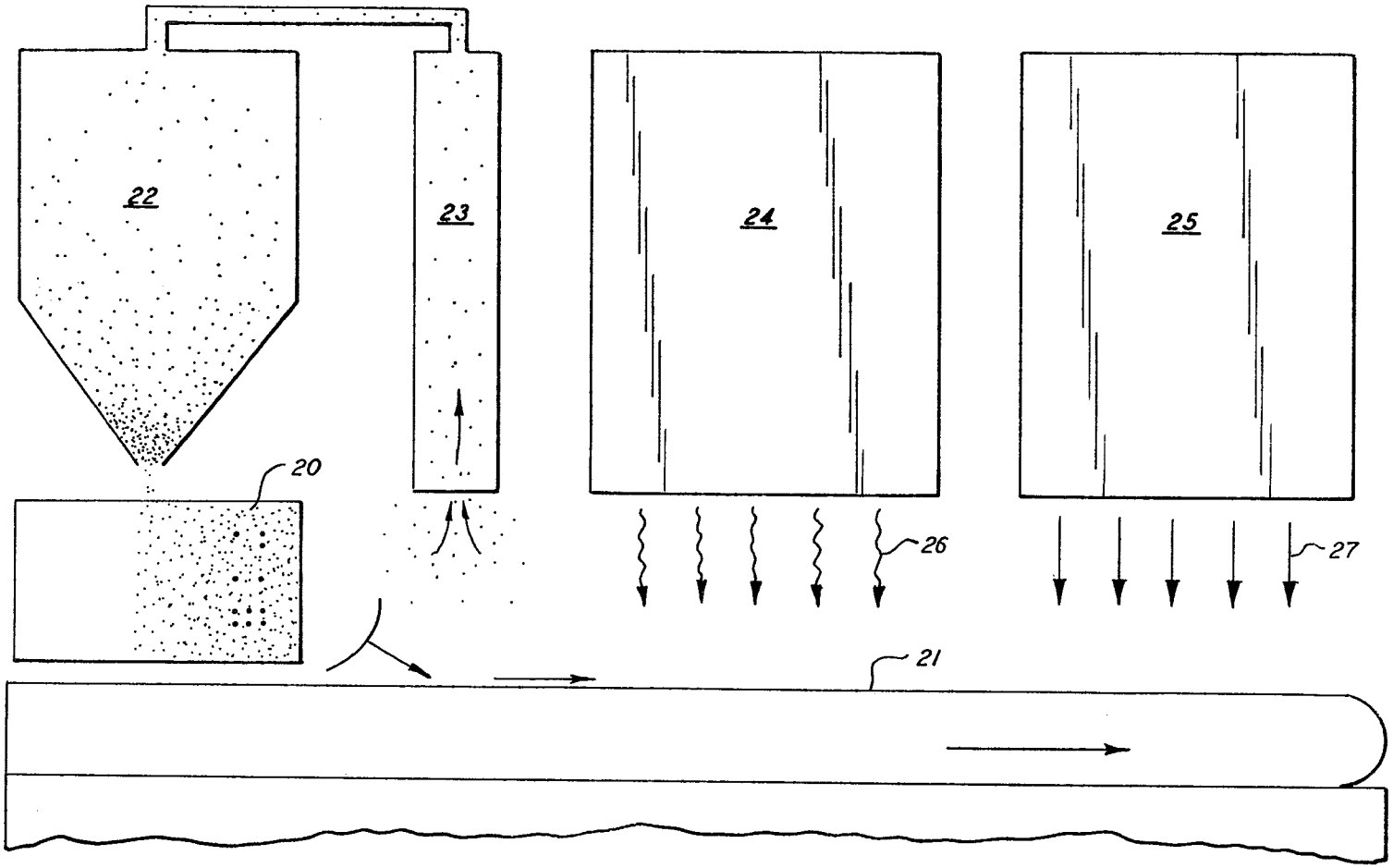
FIG. 3 is a schematic illustration of a thermography machine for use in conjunction with a braille printing method according to the present invention.

FIG. 2 schematically illustrates a typical offset printing press which can be utilized to carry out the method of the invention. The press includes a plate cylinder 16 on which the dot image of the braille characters on sheet 14 is placed in positive form by means of a lithographic printing plate 17. The plate cylinder engages a blanket cylinder 18 which receives the dot image from plate 17 in negative form. Suitable sheet material stock, such as, for example, paper, is fed between a nip formed by blanket cylinder 18 and an impression cyclinder 19 and receives the dot image in positive planar form. The sheet stock is conveyed by means of a conveyor 21, schematically illustrated in FIGS. 2 and 3, to a thermography machine, the latter of which is schematically illustrated in FIG. 3. The thermography machine includes a resin powder shaker 22 coupled to a vacuum or a suction means 23. An oven 24 is disposed adjacent suction means 23 along conveyor 21 for heating the printed sheet material stock at a temperature of about 400°–500° F. Cooling fans 25 are disposed adjacent oven 24 at the end of the conveyor for cooling the sheet stock. Heat is radiated downwardly on sheet stock 20 conveyed by conveyor 21, as indicated by the arrows 26. Likewise, cooling air is radiated downwardly towards the sheet stock as indicated by arrows 27 in the drawings.

The method of the invention will now be described in detail with reference to FIGS. 1 and 4 of the drawings:

As shown in FIG. 1, light from light source 13 is caused to pass through phototypesetting disc 10 to expose photosensitive sheet material 14 and form a positive dot image of one or more braille characters 11 and the corresponding letter of the alphabet 12 on sheet 14. Exposing sheet 14 so that a dot image of the braille characters and a corresponding letter of the alphabet both appear on sheet 14 enables the sheet to be proofread prior to proceeding with the printing steps. Sheet 14 is then developed and subsequently photographed. A negative of the developed sheet material, shown in FIG. 4(a), is then made. The negative is then stripped up on a goldenrod sheet 28 (which is an opaque sheet) so that the dot image of braille characters 11, but not the image of alphabet letters 12, are formed on the goldenrod sheet. This step is illustrated in FIG. 4(b) and comprises mounting the negative on the goldenrod sheet and cutting apertures in the sheet to permit light to pass through the negative, specifically to pass through the image of the braille characters but not the alphabet letters. The stripped negative is then exposed on a light-sensitive metal lithographic plate 17, shown in FIG. 4(c), and the plate is subsequently developed. Plate 17 is then mounted on an offset duplicator or press which is coupled to a thermography machine, for example, an Embossograph or Virko-type thermography machine. The machine is then operated and the dot image developed on exposed lithographic plate 17 is offset printed in ink on sheet material stock 20, which may comprise either paper or card stock by feeding the stock through the press. While the ink forming the dot image on the sheet material stock is still wet, the sheet is passed on conveyor 21 through the thermography machine. As shown in FIG. 2, thermographic material, such as, for example, a fusible resin powder, is deposited by means of shaker 22 on the wet ink of the dot image. The conveyor conveys sheet stock 20 past suction means 23 which sucks up the excess powder deposited on the sheet stock which has not adhered to the printed dot image on sheet stock 20 and returns it to shaker 22. The sheet stock is then conveyed past oven 24 which melts, fuses and sets the resin powder deposited on the printed dot image. The powder is thus dried and adheres to the dot image formed by the ink printed on sheet stock 20. The sheet stock is then conveyed past cooling means 25, which includes cooling fans for cooling the heated resin powder and sheet stock. The sheet stock will then have raised braille characters printed on one side thereof and may be bound, for example, as part of a book, in this form. Alternatively, the sheet can be run through the duplicating machine again for printing additional braille characters on the other side of the sheet stock before binding in a book. The sheet stock is conveyed through the thermography machine at a speed of approximately 8–9 thousand sheets per hour.

In the foregoing specification, the invention has been described with reference to specific exemplary embodiments thereof. It will be evident, however, that various changes and modifications may be made thereunto without departing from the broader spirit and scope of the invention as set forth in the appended claims. The specification and drawings, are, accordingly, to be regarded in an illustrative rather than in a restrictive sense.

What is claimed is:

1. A method for printing braille characters by means of a lithographic printing process, comprising the steps of:

exposing photosensitive sheet material to form a positive dot image of one or more braille characters on said sheet material;

developing the exposed photosensitive sheet material;

photographing said developed photosensitive sheet material and making a negative of said developed sheet material;

mounting said negative on an opaque sheet and cutting apertures in said sheet to permit light to pass through said negative;

exposing said mounted negative on a light-sensitive lithographic plate and developing said exposed plate;

mounting said developed plate on an offset printing press;

printing the dot image developed on said exposed lithographic plate in ink on sheet material stock by feeding said stock through said offset printing press;

depositing thermographic material on the image printed on said sheet material stock while the ink forming said image is still wet; and heating said sheet material stock to melt, fuse and set said thermographic material and form raised braille characters on said sheet material stock.

2. The method recited in claim 1, wherein said step of exposing said photosensitive sheet material comprises exposing photosensitive sheet material by passing light through a perforated phototypesetting disc having one or more braille characters formed therein to form a dot image of said braille characters on said sheet material.

3. The method recited in claim 1, wherein said step of exposing said photosensitive sheet material comprises exposing said photosensitive sheet material by passing light through a perforated phototypesetting disc having one or more braille characters and a corresponding letter of the alphabet represented by said braille characters disposed below each of said braille characters formed therein to form an image of said characters and letters on said sheet material, and wherein said step of cutting comprises cutting apertures in said sheet to permit light to pass through the image of said braille characters, but not said alphabet letters, on said negative.

4. The method recited in claim 1, further comprising the step of cooling said sheet material stock subsequent to said step of heating said sheet material stock.

5. The printed sheet material stock produced in accordance with the method of claim 1.

* * * * *

UNITED STATES PATENT AND TRADEMARK OFFICE

CERTIFICATE OF CORRECTION

PATENT NO. : 4,101,688

DATED : July 18, 1978

INVENTOR(S) : Martin E. Kurtzman

It is certified that error appears in the above-identified patent and that said Letters Patent are hereby corrected as shown below:

Column 1, line 35, change "ae" to -- are --.

Column 2, line 6, change "phototypsetting" to -- phototypesetting --.

Column 2, line 8, change "raille" to -- braille --.

Figure 1A:
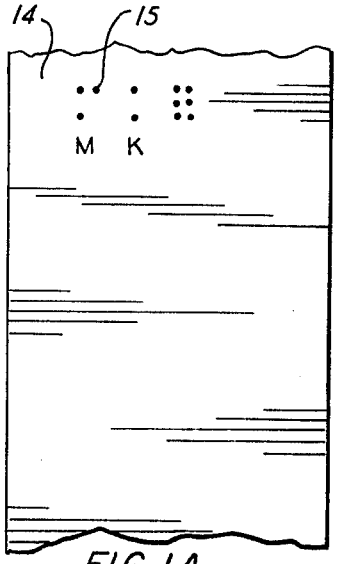

Column 3, line 1, change "Fig. 1 is a perspective view" to -- Figs. 1 and 1a are perspective views --.

Column 3, line 2, after "material" insert -- , respectively, --.

Figure 4C:
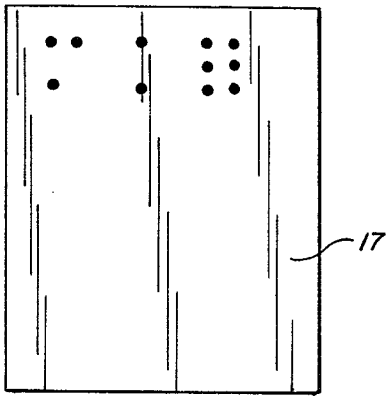
FIG. 4 is a planar illustration of the image-forming steps of a braille printing method according to the present invention.
Figure 4B:
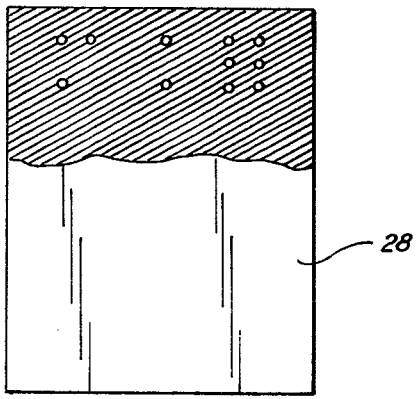
Figure 4A:
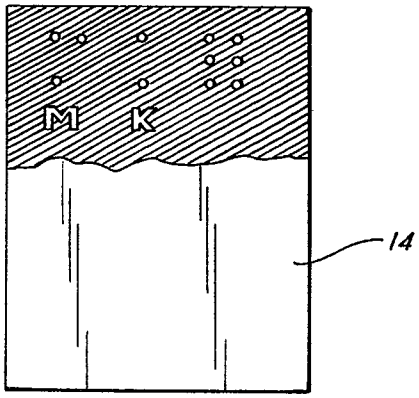

Column 3, line 11, change "Fig. 4 is a planar illustration of" to -- Figures 4a, 4b, and 4c illustrate --.

Column 3, line 26, after "14" insert -- shown in Fig. 1a --.

UNITED STATES PATENT AND TRADEMARK OFFICE

CERTIFICATE OF CORRECTION

PATENT NO. : 4,101,688

DATED : July 18, 1978

INVENTOR(S) : Martin E. Kurtzman

It is certified that error appears in the above-identified patent and that said Letters Patent are hereby corrected as shown below:

Column 3, line 53, change "cyclinder" to -- cylinder --.

Column 4, line 4, change "1 and 4" to -- 1, 1a and 4(a) through 4(c) --.

Column 4, line 5, change "Fig. 1" to -- Figs. 1 and 1a --.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*